US007164073B2

(12) United States Patent
Sperzel

(10) Patent No.: US 7,164,073 B2
(45) Date of Patent: Jan. 16, 2007

(54) STRING SUPPORT

(76) Inventor: Robert J. Sperzel, 5960 Hawthorne Hollow, North Ridgeville, OH (US) 44039-2468

( * ) Notice: Subject to any disclaimer, the term of this patent is extended or adjusted under 35 U.S.C. 154(b) by 147 days.

(21) Appl. No.: 11/056,572

(22) Filed: Feb. 11, 2005

(65) Prior Publication Data

US 2006/0179998 A1 Aug. 17, 2006

(51) Int. Cl.
*G10D 3/00* (2006.01)

(52) U.S. Cl. ..... 84/297 R; 84/314 N

(58) Field of Classification Search ..... 84/297 R, 84/314 N, 298, 304
See application file for complete search history.

(56) References Cited

U.S. PATENT DOCUMENTS 5,260,504 A * 11/1993 Turner ..... 84/297 R
5,394,783 A 3/1995 Sperzel
5,438,901 A 8/1995 Sperzel
5,492,044 A 2/1996 Sperzel
5,696,336 A 12/1997 Sperzel
6,444,886 B1 9/2002 Spercel et al.
2006/0156893 A1 * 7/2006 Kinoshita ..... 84/314 N

* cited by examiner

*Primary Examiner*—Kimberly Lockett
(74) *Attorney, Agent, or Firm*—Tarolli, Sundheim, Covell & Tummino LLP

(57) ABSTRACT

A string support assembly for use with a musical instrument includes a base member which is connected with the musical instrument adjacent to a connection between head and neck portions of the musical instrument. A plurality of pairs of string support members are connected with the base member. Each of the string support members includes a string positioning section having an arcuate outer side surfaces which engages one of the strings. A blocking section extends from the string positioning section to block movement of the string from between the string support members.

11 Claims, 3 Drawing Sheets

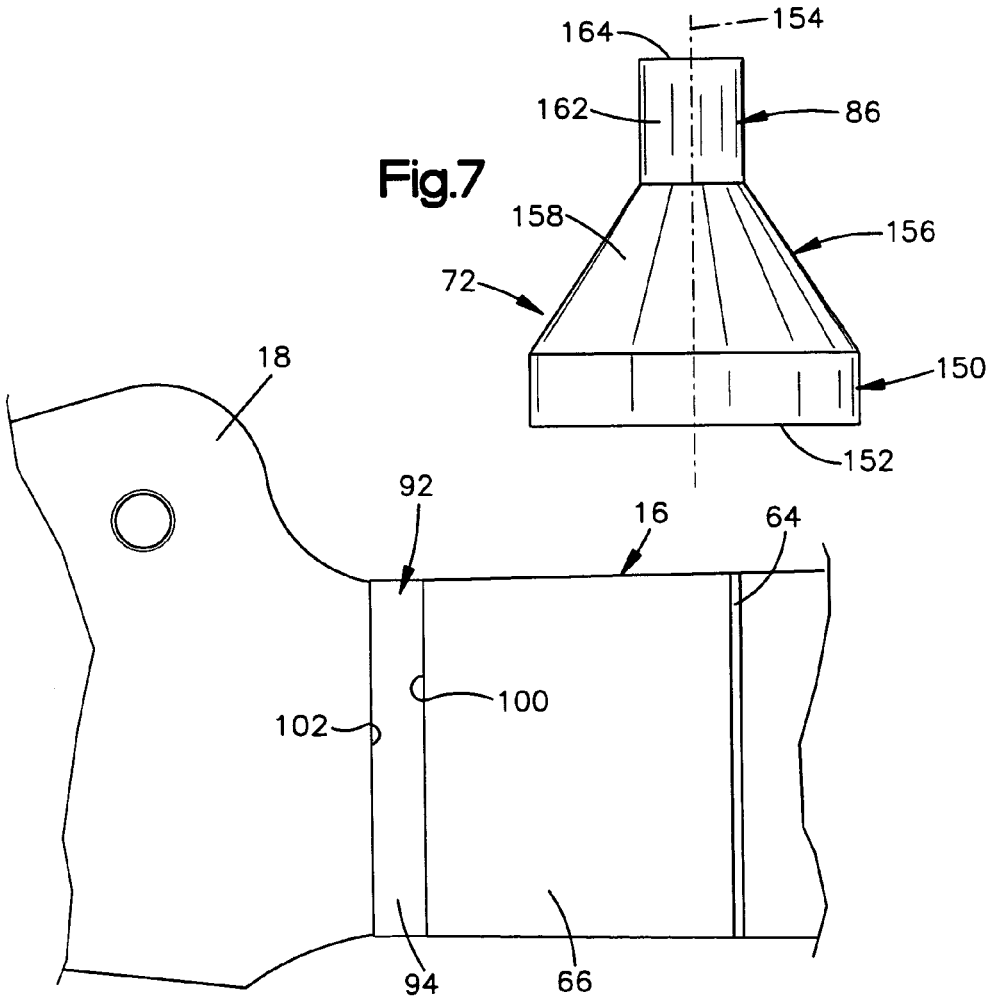
Fig.7
Fig.8
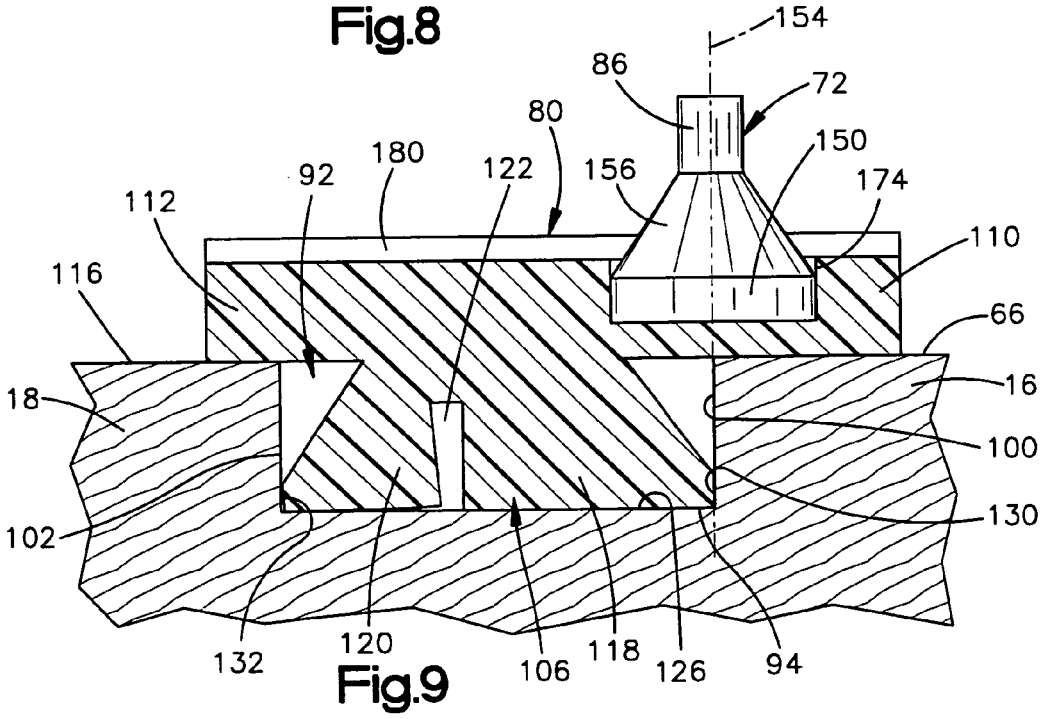
Fig.9

STRING SUPPORT

BACKGROUND OF THE INVENTION

The present invention relates to a new and improved string support assembly for use with a guitar or similar stringed instrument to position strings relative to the instrument.

Stringed musical instruments of the guitar type commonly have a body portion, a neck portion which extends outward from the body portion, and a head portion connected with the end of the neck portion opposite from the body portion. A plurality of tuning devices are mounted on the head portion and are operable to adjust the tension in strings which extend from the head portion along the neck portion to the body portion of the musical instrument. A nut or string support system is provided adjacent to a connection between the head and neck portions of the instrument. The nut positions the strings relative to the neck portion of the instrument.

The manner in which the nut cooperates with the strings is very important in obtaining the desired tone from the instrument. Thus, the nut must be accurately located to determine the effective length of the strings. The nut must hold the strings against sidewise movement in order to avoid a buzzing sound effect. During the operation of a tremolo, the nut should allow the tension in the strings to be varied in a predictable manner. The nut should be constructed in such a manner as to enable a uniform spacing to be obtained between each of the strings and the frets on the neck of the guitar.

A known string support assembly includes a base member which is connected with a musical instrument adjacent to a connection between head and neck portions of the musical instrument. A plurality of pairs of string support members are disposed on the base member. Each of the string support members has an arcuate surface which engages a string of the musical instrument. String support assemblies having this general construction are disposed in U.S. Pat. Nos. 5,492,044 and 5,696,336. Other known string support assemblies are disclosed in U.S. Pat. Nos. 5,394,783 and 5,438,901.

SUMMARY OF THE INVENTION

An improved string support is used in a musical instrument of the guitar type. This type of musical instrument commonly has a plurality of strings which extend from tuning devices on a head portion, along a neck portion, to a body portion of the instrument. The improved string support positions the strings relative to the head and neck portions of the instrument.

The string support may include a base member which is connected with the musical instrument adjacent to a connection between the head and neck portions. A plurality of pairs of string support members are connected with the base member. A first one of the pairs of string support members may include mounting sections which are connected with the base member. The first one of the pairs of string support members may have string positioning sections with arcuate outer side surfaces which engage one of the strings of the plurality of strings. A first blocking section extends from the first string positioning section in a direction away from the first mounting section to block movement of the first one of the strings from between first and second string support members in a first direction.

A second string support member in the first one of the pairs of the string support members may include a second mounting section which is connected with the base member. A second string positioning section may extend from the second mounting section. The second string positioning section may have a second arcuate side surface which engages the first one of the strings. A second blocking section extends from the second string positioning section in a direction away from the second mounting section to block movement of the first one of the strings from between the first and second string support members in a second direction.

An improved method includes providing a first plurality of string support members which are of a first size. A second plurality of string support members of a second size are also provided. The first plurality of string support members are mounted on a musical instrument at a location adjacent to a connection between head and neck portions of the musical instrument. At least one string is supported by the first plurality of string support members with the one string at a first distance from a side surface of a neck portion of the musical instrument.

The first plurality of string support members is removed from the musical instrument and a second plurality of string support members are mounted on the musical instrument at the location adjacent to the connection between the head and neck portions of the musical instrument. At least one string is supported with the second plurality of string support members with the at least one string a second distance from the side surface of the neck portion of the musical instrument.

BRIEF DESCRIPTION OF THE DRAWINGS

The foregoing and other features of the present invention will become more apparent upon a consideration of the following description taken in connection with the accompanying drawings wherein:

FIG. 7 is an enlarged pictorial illustration of one of the string support members utilized in the string support assembly of FIGS. 2 and 3;

FIG. 8 is a fragmentary and somewhat schematicized plan view, similar to FIG. 2, of a head and neck portion of the musical instrument with components removed; and FIG. 9 is an enlarged fragmentary schematic view, similar to FIG. 4, illustrating the manner in which the base member of FIGS. 4–6 engages a groove in the musical instrument.

DESCRIPTION OF SPECIFIC PREFERRED EMBODIMENTS OF THE INVENTION

General Description

Figure 1:
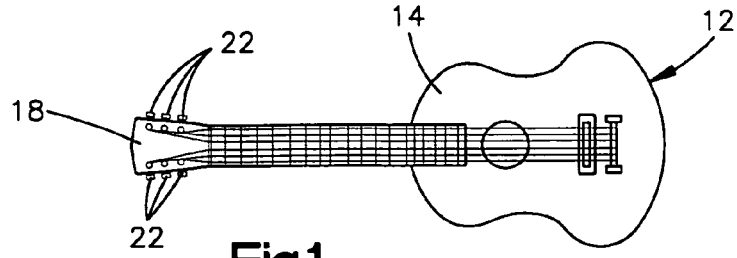
FIG. 1 is a simplified illustration of a stringed musical instrument of the guitar type.

A musical instrument 12 is shown in FIG. 1. The musical instrument 12 is a guitar and includes a body portion 14 having a sounding board. A neck portion 16 extends outward from the body portion 14 of the musical instrument 12. A head portion 18 is connected with the neck portion 16. The neck and head portion 16 and 18 are formed of wood. However, the neck and/or head portions 16 and 18 could be formed of a different material if desired.

A plurality of tuning devices 22 are provided on the head portion 18. The tuning devices are operable to adjust the tension in strings 30, 32, 34, 36, 38 and 40. The tuning devices may have a construction similar to the construction disclosed in U.S. Pat. Nos. 4,625,614; 5,728,955; and/or 6,608,248. Of course, the tuning devices 22 may have any one many different known constructions other than the specific constructions set forth in the aforementioned U.S. Patents.

The strings 30–40 extend from the tuning devices 22 on the head portion 18 along the neck portion 16 to the body portion 14 of the musical instrument 12. A tremolo may be provided on the body portion 14 to vary the tension in the strings 30–40 in a known manner. The general construction of the musical instrument 12 is well known and may be in accordance the construction of any one of many different commercially available guitars or similar musical instruments. It is contemplated that is may be desired to construct the musical instrument 12 in the manner disclosed in U.S. Pat. No. 6,444,886.

An improved string support assembly 44 (FIGS. 2 and 3), constructed in accordance with the present invention, is provided adjacent to a connection 46 (FIG. 2) between the neck portion 16 and head portion 18 of the musical instrument 12. The string support assembly 44 positions the strings 30–40 relative to the neck portion 16 of the musical instrument 12. The string support assembly 44 performs functions performed by a nut in known guitars.

The improved string support assembly 44 includes a plurality of string supports 50, 52, 54, 56, 58, and 60 (FIG. 2) which are disposed in a linear array. There is a string support 50–60 for each of the strings 30–40. The string supports 50–60 engage strings 30–40 to support them relative to each other and to frets 64 on the neck portion 16 of the musical instrument 12. One of the string supports 50–60 is associated with one of the strings 30–40. The string support 50–60 associated with a string 30–40 is effective to support the string at a predetermined distance from an upper side surface 66 (FIG. 2) of the neck portion 16 of the musical instrument 12.

Figure 2:
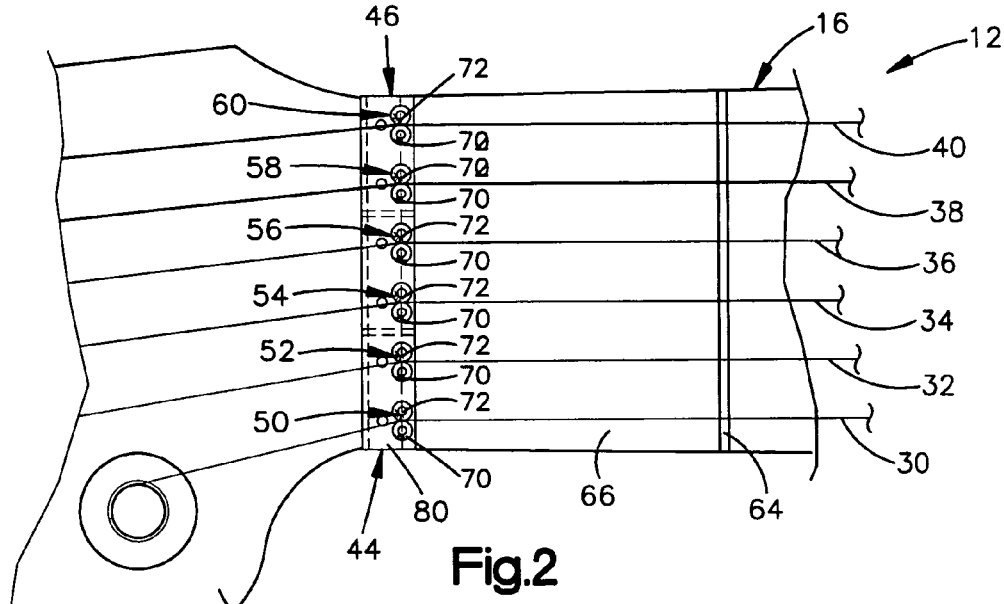
FIG. 2 is an enlarged fragmentary and somewhat schematicized plan view illustrating a relationship between a neck portion, a head portion, and a plurality of strings in the musical instrument of FIG. 1.
Figure 3:
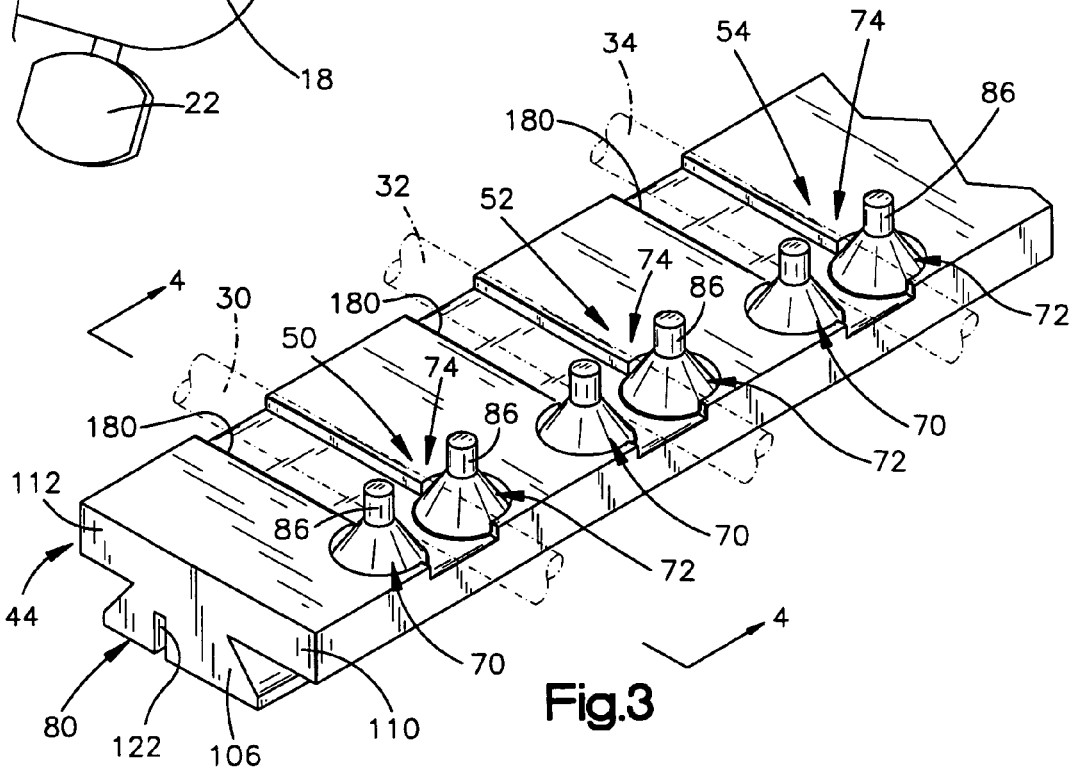
FIG. 3 is an enlarged pictorial illustration of a portion of a string support assembly utilized in the musical instrument of FIGS. 1 and 2 and constructed in accordance with the present invention.
Figure 5:
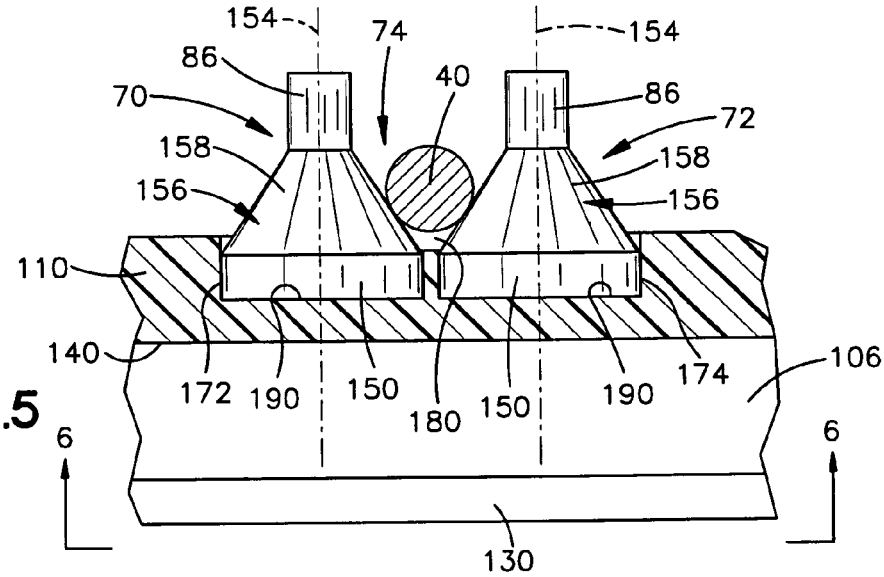
FIG. 5 is a fragmentary sectional view, taken generally along the line 5–5 of FIG. 4, illustrating the manner in which a pair of string support members are mounted on the base member and engage a string.
Figure 6:
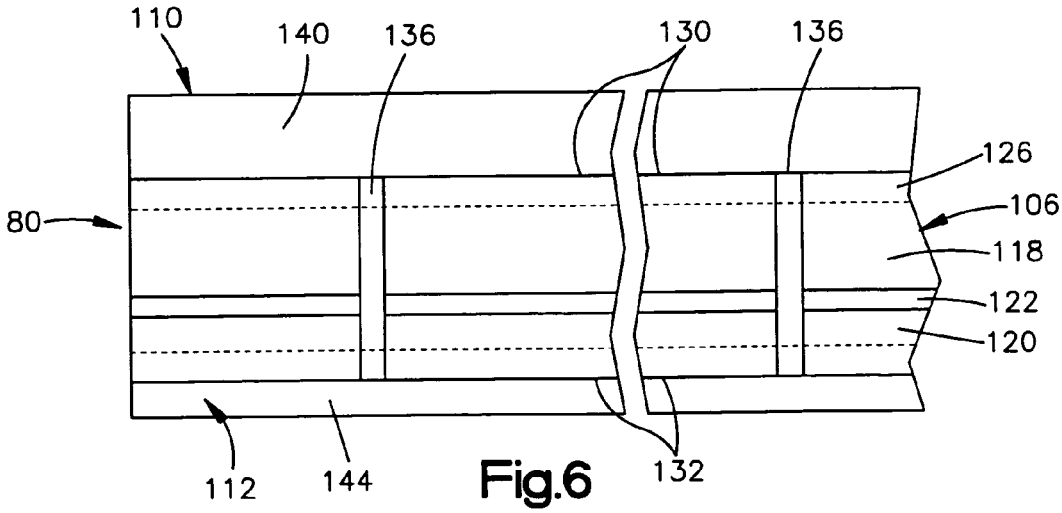
FIG. 6 is a fragmentary plan view, taken generally along the line 6–6 of FIG. 5, further illustrating the construction of the base member used in the string support assembly.

Each of the string supports 50–60 includes a pair of string support members 70 and 72 (FIGS. 2, 3, and 5). The string support members 70 and 72 in each string support 50–60 cooperate to support one of the strings 30–40 (FIG. 5). The string support members 70 and 72 enable each of the 30–40 (FIG. 2) to be supported at a predetermined location along the neck portion 16 of the musical instrument 12 to provide an accurately located intonation point for the string. The string support members 70 and 72 also accurately locate the strings 30–40 relative to the frets 64 on the neck portion 16 of the musical instrument 12. The string supports 50–60 position the strings 30–40 a predetermined distance above the upper side surface 66 on the neck portion 16 of the musical instrument 12.

In addition to locating the strings 30–40, the string support members 70 and 72 cooperate with the strings to hold them against sidewise movement at the string support assembly 44. This minimizes objectionable noise or buzzing. The string support members 70 and 72 enable the strings to extend in either a continuous straight line along the neck portion 16 and head portion 18 or to bend at the string support assembly 44. This enables the string supports 50–60 to be used with guitars having tuning devices at almost any desired location on the head portion 18 of the musical instrument 12.

The string support members 70 and 72 in the string supports 50–60 enable the strings 30–40 to have different diameters. Thus, the diameters of the strings 30–40 progressively increase from a relatively small diameter string 30 to a relatively large diameter string 40. A reason that the identical string supports 50–60 may be used with the strings of different diameters is that the outer side surfaces of the string support members 70 and 72 cooperate to form a recess or nip 74 (FIGS. 3 and 5) which tapers downwardly (as viewed in FIG. 3). The tapering nip 74 allows the string support members 70 and 72 to engage opposite sides of strings 30–40 having different diameters and to hold the different diameter strings against sidewise movement. If desired, the string supports 50–60 may have dimensions corresponding to the diameter of the strings with which the string supports are used.

The string support members 70 and 72 are mounted on a one piece base member 80 (FIGS. 3–6). However, the base member 80 may be eliminated if desired. If this is done, the string support members 70 and 72 would be mounted directly on the material forming the connection 46 between the neck and head portions 16 and 18 of the musical instrument 12. The manner in which the string support members 70 and 72 cooperate with the strings 30–40 is generally the same as is disclosed in U.S. Pat. Nos. 5,492,044 and 5,696,336.

Figure 4:
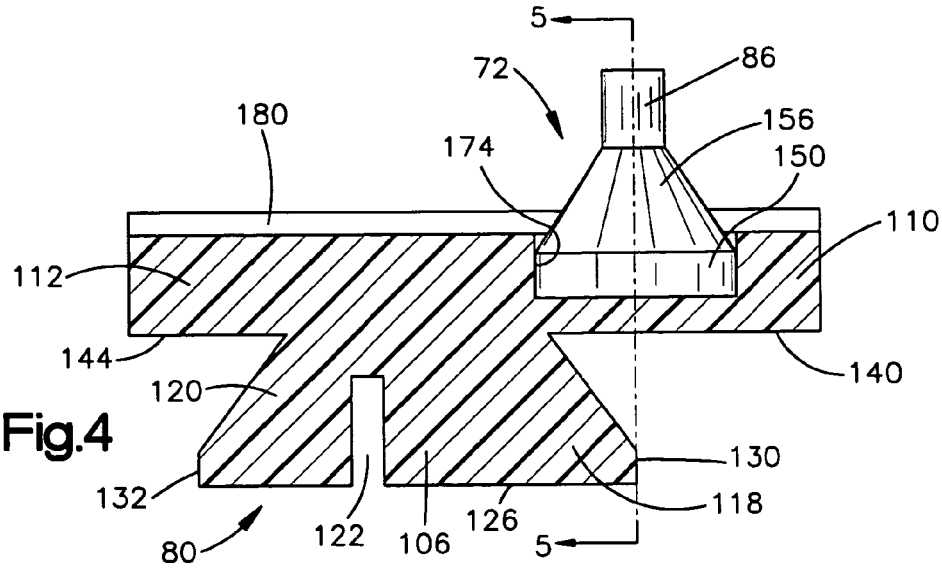
FIG. 4 is a sectional view, taken generally along the line 4–4 of FIG. 3, illustrating the relationship of a string support member to a base member in the string support assembly of FIG. 3.

In accordance with one of the features of the present invention, the string supports 70 and 72 each include a blocking section 86 (FIGS. 4, 5 and 7). The blocking sections 86 on the string supports 70 and 72 cooperate to prevent moving of one of the strings 30–40 out of the recess or nip 74 between the string support members 70 and 72. Thus, the blocking section 86 on the left (as viewed in FIG. 5) string support member 70 blocks leftward sideways movement of the string 40 out of the recess or nip 74. Similarly, the blocking section 86 on the right string support member 72 blocks rightward sideways movement of the string 40 out of the recess or nip 74.

Base Member

The string support assembly 44 includes a one-piece base member 80 (FIGS. 3–6). The base member 80 is formed from a single piece of material. In the embodiment of the invention illustrated in FIGS. 3–6, the base member 80 is formed of a polymeric material. However, the base member may be formed of other materials if desired. For example, the base member 80 may be formed of metal.

The base member 80 has a generally rectangular configuration. The base member 80 extends across the neck portion 16 (FIG. 2) of the musical instrument 12. The base member 80 has a longitudinal central axis which extends parallel to the longitudinal central axis of the fret 64. The longitudinal central axis of the base member 80 extends transverse to the strings 30–40. The longitudinal central axis of the base member 80 extends perpendicular to the portions of the strings 30–40 which extend across the frets 64 on the neck portion 16 of the musical instrument 12. The longitudinal central axis of the base member 80 is skewed at an acute angle to the portions of the strings 30–40 which extend from the string support assembly 44 to the tuning devices 22.

The upper side surface 66 on the neck portion 16 (FIG. 2) of the musical instrument 12 has an arcuate configuration. The upper side surface 66 of the neck portion 16 is formed as a portion of a cylinder which has a relatively large diameter. Thus, the upper side surface 66 on the neck portion 16 may have a radius of curvature of ten inches or more.

The base member 80 is received in a linear groove 92 (FIG. 8) formed in the musical instrument at a location where the neck portion 16 and head portion 18 (FIG. 2) are interconnected. The groove 92 has a generally rectangular configuration (FIGS. 8 and 9). However, the groove 92 has a rectangular bottom surface 94 with an arc of curvature which is less than the arc of curvature of the upper side surface 66 in the neck portion of the musical instrument. The center of curvature for the bottom surface 94 of the groove 92 is coincident with the center of curvature for the upper side surface 66. This results in the groove 92 having a uniform depth throughout the extent of the groove. However, the bottom surface 94 of the groove 92 may have a flat configuration if desired. This would result in the groove 92 being shallower at its opposite ends than at a central portion of the groove. The opposite ends of a groove 92 with a flat bottom surface would have a depth sufficient to receive the base member 80.

The groove 92 has parallel flat front and rear side surfaces 100 and 102 (FIGS. 8 and 9). The front and rear side surfaces 100 and 102 of the groove 92 extend parallel to the frets 64. The spacing between the front side surface 100 of the groove 92 and the fret 64 (FIG. 8) remains constant throughout the length of the groove 92 and the length of the fret 64.

The base member 80 has a body portion 106 which is received in the groove 92 (FIG. 9) at the connection between the neck portion 16 and head portion 18 of the musical instrument 12. In addition, the base member 80 (FIG. 4) has a front flange 110 and a rear flange 112 (FIG. 4). The front and rear flanges 110 and 112 are integrally formed as one piece with a body portion 106 and extend in opposite directions from the body portion 106.

When the base member 80 is disposed in the groove 92 (FIG. 9), the front flange 110 overlies a portion of the upper side surface 66 of the neck portion 16 disposed between the front side surface 100 of the groove 92 and the fret 64. Similarly, the rear flange 112 overlies a surface 116 on the head portion 18. The front and rear flanges 110 and 112 are resiliently deflected so that they firmly engage the arcuate surfaces 66 and 116 on the neck portion 16 and head portion 18 of the musical instrument 12.

When the base member 80 is installed in the groove 92 (FIG. 9), the body portion 106 is partially disposed in the groove 92 and extends between the front and rear side surfaces 100 and 102 of the groove. The body portion 106 includes a front section 118 and a rear section 120 which are separated by a slot 122 (FIG. 4). The front section 118 is larger than the rear section 120 of the body portion 106. However, if desired, the rear section 120 of the body portion 106 may be made larger than the front section 118. When the base member 80 has been resiliently deflected to have an arc of curvature which corresponds to the arc of curvature of the upper side surface 66 on the neck portion 16 and the bottom surface 94 of the groove 92, the body portion 106 of the base member engages the bottom surface of the groove throughout the longitudinal extent of the groove (FIG. 9).

Prior to insertion into the groove 92, the body portion 106 of the base member 80 has a flat rectangular bottom surface 126 (FIG. 4). In addition, the body portion has flat parallel front and rear side surfaces 130 and 132.

The slot 122 extends parallel to the front and rear side surfaces 130 and 132. The front and rear side surfaces 130 and 132 and the slot 122 extend perpendicular to the bottom surface 126 of the body portion 106. The slot 122 increases the flexibility of the body portion 106 and enables the front and rear sections 118 and 120 to be flexed towards each other, in the manner illustrated schematically in FIG. 9, as the body portion 106 is inserted into the groove 92 in the musical instrument 12. As this occurs the width of the slot 122 is decreased throughout the length of the slot. The slot 122 has a length which corresponds to the length of the base member 80. The slot 122 extends parallel to the longitudinal central axis of the base member 80 throughout the length of the base member.

To enable the base member 80 to be resiliently flexed so that the front and rear flanges 110 and 112 and body portion 106 have an arc of curvature corresponding to the arc of curvature of the upper side surface 66 (FIG. 2) of the neck portion 16, transverse slots 136 (FIG. 6) are formed in the body portion 106. The transverse slots 136 extend perpendicular to the longitudinal slot 122 and have a depth which is slightly greater than the depth of the longitudinal slot 122. However, if desired, the slots 122 and 136 may have the same depth or the slot 122 may be deeper than the slots 136. The slots 122 extend perpendicular to the front and rear side surfaces 130 and 132 of the body portion 106.

The slots 136 increase the flexibility of the base member 80 so that the base member can be resiliently deflected to conform to the arcuate configuration of the upper side surface 66 of the neck portion 16. This enables the lower (as viewed in FIG. 4) side surface 140 on the front flange 110 to be resiliently deflected to an arcuate configuration corresponding to the arcuate configuration of the upper side surface 66 of the neck portion 16 of the musical instrument 12. Similarly, the transverse slots 136 enable lower side surface 144 (FIG. 4) on the rear flange 112 to be resiliently deflected to an arcuate configuration corresponding to the arcuate configuration of the upper side surface of the head portion 18 of the musical instrument 12. It should be understood that the upper side surface of the head portion 18 of the musical instrument 12 is arcuate only in the area adjacent to the groove 92 (FIG. 8) in which the string support assembly 44 (FIG. 2) is received. The remainder of the upper side surface of the head portion 18 is flat.

The longitudinal slot 122 (FIGS. 4 and 6) enables the body portion 106 of the base member 80 to be resiliently flexed so that the body portion of the base member will fit in the groove 92 in the manner illustrated schematically in FIG. 9. Thus, the distance between the front side surface 130 and the rear side surface 132 (FIG. 4) on the body portion 106 of the base member 80 is greater than the distance between the front side surface 100 and rear side surface 102 (FIG. 8) of the groove 92. Therefore, the body portion 106 of the base member 80 is resiliently compressed and wedged into the groove 92 when the base member 80 is mounted in the groove 92 in the manner illustrated schematically in FIG. 9.

This resilient wedging engagement of the base member 80 with the groove 92 results in the base member being releasably held in place by engagement of the front side surface 130 on the body portion 106 with the front side surface 100 of the groove and engagement of a rear side surface 132 on the body portion 106 of the base member 80 with a rear side surface 102 of the groove 92. The base member 80 can be disengaged from the groove 92 by merely pulling upward (as viewed in FIG. 9) on the base member. As the base member 80 is disengaged from the groove 92, the body portion 106 resiliently expands to the initial configuration of FIG. 4 and the flanges 110 and 112 resiliently return to their initial linear configuration.

String Support Members

The metal string support members 70 and 72 (FIGS. 3, 4, 5, and 7) have the same construction. The metal string support member 72 includes a cylindrical shank or mounting section 150 (FIG. 7). The mounting section 150 has a flat circular bottom surface 152. A vertical (as viewed in FIG. 7) central axis 154 of the string support member 72 extends through the center of the bottom surface 152.

The string support member 72 includes a string positioning section 156 which extends between the mounting section 150 and the blocking section 86. The string positioning section 156 is formed as a portion of a right circular cone. A central axis of the string positioning section 156 is coincident with the central axis 154 of the string support member 72.

The string positioning section 156 has an arcuate outer side surface 158. The arcuate outer side surface 158 has the configuration of a portion of a right circular cone. However, the arcuate outer side surface 158 could have a different configuration if desired. For example, the outer side surface 158 of the string positioning section 156 could be formed as a portion of a sphere. The remaining portion of the outer side surface 158 may have any desired configuration. At the location where the outer side surface 158 is engaged by a string, such as the string 40 of FIG. 5, the outer side surface 158 (FIG. 7) of the string support member 72 has an arcuate configuration.

The blocking section 86 extends upward from the string support section 156. The blocking section 86 is effective to block sideways movement of a string across the upper end of the string positioning section 156. The blocking sections 86 on the two string support members 70 and 72 (FIG. 5) are effective to retain a string 40 against either left or right sideways movement out of the recess or volley 74 between the two string support members 70 and 72.

The blocking section 86 (FIG. 7) has a cylindrical configuration. The blocking section 86 has a cylindrical side surface 162 which extends upward from the upper end of the outer side surface 158 of the string positioning section 156. In addition, the blocking section 86 has a circular end surface 164. The end surface 164 extends parallel to the bottom surface 152.

The blocking section 86, string positioning section 156, and mounting section 150 all have central axes which are coincident with the central axis 154 of the string support member 72. Although the illustrated blocking section 86 has a cylindrical configuration, the blocking section may have a different configuration if desired. For example, the blocking section 86 may have a polygonal configuration if desired. Although the blocking section 86, string positioning section 156, and mounting section 150 are coaxial, one or more of the sections may have central axes which are offset from central axes of the other sections.

The string support member 70 (FIG. 5) in any one of the string supports 50–60 (FIG. 2) has the same construction as the string support member 72 in that particular string support. The central axes 154 of the string support members 70 and 72 (FIG. 4) are disposed in a parallel relationship. Since the string supports 50–60 (FIG. 2) are associated with strings 30–40 of different diameters, the string supports 50–60 may have pairs of metal string support members 70 and 72 with dimensions which depend upon the diameter of the string which is engaged by a string support. It is also contemplated that the string support members 70 and 72 in the string supports 50–60 may be identical even though the strings 30–40 have different diameters.

In the illustrated embodiment of the string supports 50–60, the identical metal string support members 70 and 72 all have mounting sections 150, string positioning sections 156, and blocking sections 86 (FIG. 7) having the same diameter and axial height. This results in the strings 30–40 which have different diameters, being supported with their uppermost portions different distances from the arcuate side surface 66 of the neck portion 16. However, it is contemplated that the axial extent of the various string support members 70 and 72 in the string supports 50–60 may be different so that the uppermost portions of each of the strings 30–40 is the same distance from the upper side surface 66 of the neck portion 16. In such a string arrangement, the greater the diameter of the string 30, 32, 34, 36, 38 or 40 supported by a string support 50, 52, 54, 56, 58 or 60, the smaller would be the axial extent of the mounting section 150 of the string support members 70 and 72.

Although it is contemplated that the conical string support sections 156 of the string support members 70 and 72 will have string positioning sections with the same cone angle, it is contemplated that the string positioning sections may have different cone angles and/or different axial extents if desired. However, as was previously mentioned, the string support members 70 and 72 in the string supports 50–60 are all of the same size and have the same configuration.

The illustrated one piece metal string support member 72 (FIG. 7) has a coaxial mounting section 150, string support section 156, and blocking section 86 with circular cross sectional configurations. However, the various portions of the illustrated string support member 72 may have different configurations if desired. For example, the mounting section 150 and/or blocking section 86 may have a polygonal cross sectional configuration. As a further example, only a portion of the string support section 156 may have an arcuate cross sectional configuration.

It is contemplated that different musicians will want the strings 30–40 of the musical instrument 12 to be spaced different distances from the arcuate upper side surface 66 of the neck portion 16 of the musical instrument (FIG. 2). To accomplish this, the string support assembly 44 may be constructed with string support members 70 and 72 with mounting sections of different sizes. For example, when a musician wants the strings 30–40 to be relatively close to the upper side surface 66 on the neck portion 16, the string support members 70 and 72 in the string supports 50–60 would all have cylindrical mounting sections 150 with a relatively small axial extent. Similarly, if a musician wants the strings 30–40 to be spaced relatively far from the upper side surface 66 of the neck portion 16, the string support members 70 and 72 in the string supports 50–60 would be constructed with cylindrical mounting sections 150 having a relatively large axial extent.

It is believed that in order to accommodate the desires of different musicians in regard to string positioning relative to the upper side surface of the neck portion 16, the axial extent of the mounting section 150 may vary between 0.040 and 0.055 inches. It should be understood that the foregoing specific range of sizes for the axial extent of the mounting section 150 on the string support members 70 and 72 has been set forth herein for purposes of clarity of description and not for purposes of limitation of the invention. It is contemplated that the mounting sections 150 may have any desired range of sizes.

The string support members 70 and 72 (FIG. 5) are mounted in openings or recesses 172 and 174 (FIG. 5) in the base member 80. The recesses 172 and 174 have cylindrical configurations corresponding to the cylindrical configurations of the mounting sections 150 of the string support members 70 and 72. However, if the mounting sections 150 of the string support members 70 and 72 have a configuration other than the illustrated cylindrical configuration, the recesses 172 and 174 would have configurations corresponding to the non-cylindrical configuration of the mounting sections.

The cylindrical recesses 172 and 174 are almost, but not quite tangent to each other. Thus, recess 172 is separated from the recess 174 by a relatively small distance. The separation between the recesses 172 and 174 may be approximately 0.0015 inches. Of course, the recesses 172 and 174 may be separated by a different distance if desired. It is also contemplated that the recesses 172 and 174 may be constructed so as to intersect.

If the recesses 172 and 174 are constructed so as to intersect, the mounting sections 150 of the string support members 70 and 72 may be configured to have relatively small flat surface areas which are disposed in abutting engagement when the string support members 70 and 72 are disposed on the base member. Alternatively, the string support members 70 and 72 may be formed as one piece and be interconnected at their base sections 150. If this is done, the one piece base section for the two string support members 70 and 72 may have a configuration which is different than the illustrated cylindrical configurations of the base section 150.

In the embodiment of the invention illustrated in FIG. 5, the recesses 172 and 174 have a cylindrical configuration and have a depth which is somewhat greater than the axial extent of the mounting sections 150. Grooves 180 are provided in the base member 80 to provide clearance for the strings 30–40. The metal string support members 70 and 72 are secured to the base member 80 by an interference fit between cylindrical outer side surfaces of the mounting sections 150 and the polymeric material forming cylindrical inner side surfaces of the recesses 172 and 174.

The string 40 is supported in a spaced apart relationship with the base member 80 by engagement with the string positioning sections 156 of the string support members 70 and 72. The arcuate side surfaces of the string support sections 156 on the string support members 70 and 72 engage opposite sides of the string 40 to support the string. The arcuate side surfaces of the string support sections 156 on the string support members 70 and 72 have points of engagement with opposite sides of the string 40. These points of engagement may be referred to as intonation points. Thus, the arcuate side surface 158 of the string positioning section 156 of the string support member 70 has a point of tangential engagement with the right side of the cylindrical outer surface of the string 40. Similarly, the arcuate outer side surface 158 of the string positioning section 156 of the string support member 72 has a point of tangential engagement with the left (as viewed in FIG. 5) side of the cylindrical outer surface of the string 40.

When the string 40 is flexed during playing of the musical instrument 12, the string is free to move along its longitudinal axis relative to the string support members 70 and 72. This is because the cylindrical outer side surface of the string 40 engages the string support sections 156 of the string support members 70 only at the point where it is tangent to the arcuate outer side surfaces 158 of the string support sections. Therefore, there is an intonation point of support between the string 40 and each of the string support members 70 and 72. When the string 70 moves along its longitudinal axis during playing of the musical instrument 12, the location of the point of engagement of the string with a string support members 70 and 72 does not change relative to the frets 64. Of course, the location at which the string support members 70 and 72 engage the string 40 moves along the surface of the string as the string moves relative to the string support members.

The central axes 154 of the string support members 70 and 72 (FIG. 5) are disposed in a spaced apart parallel relationship when the string support members are in the recesses 172 and 174. When the base member 80 is positioned in the groove 90 (FIG. 9), the central axes 154 of the string support members are all disposed in a plane containing the front surface 100 (FIGS. 8 and 9) of the groove 92. This results in the points of engagement of the string support sections 156 of the string support members 72 and 74 with the strings 30–40 all being disposed in the same plane as is the front surface 100 of the groove 92 and the central axes 154 of the string support members. Therefore, the intonation points of all of the strings 30–40 are disposed in a common plane which contains the front side surface 100 of the groove 92. Although, the location of the points of engagement of the string support members 70 and 72 along the length of the string 40 may vary as the string moves during playing a musical instrument 12, the location of the points of engagement of the string support members 70 and 72 with opposite sides of the strings 30–40 remain in the same place relative to the neck portion 16 of the musical instrument, that is, in the plane containing the front side surface 100 of the groove 92.

The parallel grooves 180 (FIGS. 3, 4, 8 and 9) are provided in the upper side of base member 80. The grooves 180 extend across the base member 80 and receive the strings 30–40. The grooves 180 allow the strings 30–40 to be disposed relatively close to the upper side surface 66 of the neck portion 16 without engaging the base member 80. If sufficient clearance is provided between the strings 30–40 and the base member 80, the grooves 180 may be omitted.

Selecting A

String Support Assembly

It is contemplated that different musicians may desire string support assemblies having different constructions. For example, a first musician may want the strings 30–40 to be relatively close to the upper side surface 66 of a neck portion 16 of the musical instrument. A second musician may want the strings 30–40 to be spaced a substantial distance from the upper side surface 66 of the neck portion 16 of the musical instrument. It is also contemplated that a musician may want to play the instrument 12 with the strings 30–40 spaced a first distance from the upper side surface 66 of the neck portion 16 and subsequently play the instrument with the strings spaced a second distance from the upper side surface of the neck portion. This would allow the musician to select the distance which he or she liked best.

When the strings 30–40 are to be relatively close to the upper side surface 66 of the neck portion 16 of the musical instrument 12, the string support members 70 and 72 will have mounting sections 150 (FIG. 5) with a relatively short axial extent. This will result in the points of engagement of the string 40 with the string positioning sections 156 being disposed relatively close to the circular bottom surfaces 190 of the recesses 172 and 174. Therefore, the string 40 will be disposed relatively close to the upper side surface 66 of the neck portion 16.

Similarly, when it is desired to have the strings 30–40 placed further from the upper side surface 66 of the neck portion 16, the mounting sections 150 of the string support members 70 and 72 will have a relatively large axial extent. This will result in the points of engagement of the string support members 70 and 72 with the string 40 being disposed further above (as viewed in FIG. 5) the circular bottom surfaces 190 of the recesses 172 and 174. Therefore, the string 40 is positioned further from the upper side surface 66 on the neck portion 16 of the musical instrument 12.

It is contemplated that a musician may want to try a musical instrument 12 with the strings 30–40 at different distances from the upper side surface 66 of the neck portion 16. To satisfy this desire on the part of the musician, two different string support assemblies 44 may be constructed. A first string support assembly 44 will have string support members 70 and 72 with mounting sections 150 having a relatively small axial extent. When this string support assembly is mounted on the musical instrument 12, the strings 30–40 will be relatively close to the upper side surface 66 of the neck portion 16.

A second string support assembly 44 will be constructed with string support members 70 and 72 having mounting sections 150 with a relatively large axial extent. When this string support assembly is mounted on the musical instrument 12, the strings 30–40 will be disposed at a relatively large distance from the upper side surface 66 of the neck portion 16. After the musician has tried the musical instrument 12 with the two different string support assemblies 44, the musician can select the string support assembly which he or she prefers.

The base member 80 is held in positioning the groove 92 (FIG. 9) by wedging engagement of the body portion 106 of the base member with the opposite side surfaces 100 and 102 of the groove. Therefore, when the strings 30–40 have been disengaged from a string support assembly 44 by loosening of the strings, the string support assembly can be readily removed from the musical instrument by manually pulling upward, that is, in a direction away from the bottom surface 94 of the groove 92 (FIG. 9). As this occurs, the front side surface 130 and rear side surface 132 (FIG. 4) on the body portion 106 of the base member 80 will slide up front and rear side surfaces 100 and 102 of the groove 92 until the base member is disengaged from the groove.

Once this has been done, the first string support assembly 44 having string support members 70 and 72 with a relatively short axial length can be separated from the musical instrument 12 and the second string support assembly having string support members with mounting sections 150 having a relatively large axial extent can be positioned in the groove. This is accomplished by manually pressing the second string support assembly 44 into the groove 92.

To manually press the second string support assembly into the groove 92, the front side surface 130 on the base member 80 is aligned with the front side surface 100 of the groove 92. The front side surface 130 on the body portion 106 of the base member 80 is then manually moved downward (as viewed in FIG. 9) into the groove 92. As this occurs, the front side surface 130 on the body portion 106 of the base member 80 slides along the front side surface 100 of the groove until the front flange 110 engages the upper side surface 66 on the neck portion 16. At this time, the front section 118 may engage the bottom surface 94 of the groove 92 or may be spaced a short distance from the bottom surface of the groove.

Force is then manually applied against the rear flange 112 on the base member 80. This results in the rear section 120 of the body portion 106 of the base member 80 resiliently flexing toward the front section 118 of the body portion 106. As this occurs, the size of the slot 122 is reduced (FIG. 9) and the rear section 120 of the base member 80 is manually forced downward (as viewed in FIG. 9) into the groove 92. Manual pressure is then applied against both the front and rear flanges 110 and 112 on the base member 80 to transversely flex the base member and firmly position the base member relative to the neck portion 16 of the musical instrument 12. At this time, the bottom surface 126 (FIG. 4) of the body portion 106 may engage the bottom surface 94 of the groove 92 (FIG. 9) or may be spaced a short distance form the bottom surface of the groove.

In the foregoing description, two different string support assemblies 44 were utilized to enable a musician to play the musical instrument 12 with the strings 30–40 spaced different distances from the upper side surface 66 of the neck portion 16. It is contemplated that a single base member 80 may be mounted in the groove 92 and the string support members 70 and 72 changed to position the strings 30–40 different distances from the upper side surface 66 of the neck portion 16. Thus, the support members 70 and 72 having mounting sections 150 with a relatively small axial extent may be initially positioned in the recesses 172 and 174 in the base member 80. This results in the strings 30–40 positioned relatively close to the upper side surface 66 of the neck portion 16 of the musical instrument 12.

After the musician has played the musical instrument 12 with the strings 30–40 positioned relatively close to the upper side surface 66 of the neck portion 16, the string support members 70 and 72 may be removed from the recesses 172 and 174 in the base member 80. String support members 70 and 72 having mounting sections 150 with a relatively large axial extent can then be positioned in the recesses 172 and 174 in the base member 70. This would enable the musician to play the musical instrument 12 with the strings 30–40 positioned further from the upper side surface 66 of the neck portion 16.

In the foregoing description, the string support members 70 and 72 in the base 80 were changed while the base member 80 remained in the groove 90. It is contemplated that the base member 80 may be removed from the groove 92 with the initial string support members 70 and 72 having mounting sections with a relatively small axial extent still disposed in the recesses 172 and 174. The initial string support members 70 and 72 can then be removed from the recesses 172 and 174 and the second string support members, having mounting sections 150 with a relatively large axial extent, are positioned in the recesses 172 and 174. After this has been done, the base member 80 may be repositioned in the groove 92 in the manner previously explained.

CONCLUSION

In view of the foregoing description, it is believed that it will be clear that the present invention relates to a new and improved string support 50–60 used in a musical instrument 12 of the guitar type. This type of musical instrument commonly has a plurality of strings 30–40 which extend from tuning devices 22 on a head portion 18, along a neck portion 16, to a body portion 14 of the instrument 12. The improved string support 50–60 positions the strings 30–40 relative to the head and neck portions 18 and 16 of the instrument 12.

The string support may include a base member 80 which is connected with the musical instrument 12 adjacent to a connection 46 between the head and neck portions 18 and 16. A plurality of pairs of string support members 70 and 72 are connected with the base member 80. A first one of the pairs of string support members 70 and 72 may include mounting sections 150 which are connected with the base member 80. The first one of the pairs of string support members 70 and 72 may have string positioning sections 156 with arcuate outer side surfaces 158 which engage one of the strings of the plurality of strings. A first blocking section 86 extends from the first string positioning section 156 in a direction away from the first mounting section 150 to block movement of the first one of the strings from between first and second string support members 70 and 72 in a first direction.

A second string support member 72 in the first one of the pairs of the string support members 70 and 72 may include a second mounting section 150 which is connected with the base member 80. A second string positioning section 156 may extend from the second mounting section 150. The second string positioning section 156 may have a second arcuate side surface 158 which engages the first one of the strings. A second blocking section 86 extends from the second string positioning section 156 in a direction away from the second mounting section 150 to block movement of the first one of the strings from between the first and second string support members 70 and 72 in a second direction.

An improved method includes providing a first plurality of string support members 70 and 72 which are of a first size. A second plurality of string support members 70 and 72 of a second size are also provided. The first plurality of string support members 70 and 72 are mounted on a musical instrument 12 at a location adjacent to a connection 46 between head and neck portions 18 and 16 of the musical instrument 12. At least one string 40 is supported by the first plurality of string support members 70 and 72 with the one string at a first distance from a side surface of a neck portion 16 of the musical instrument 12.

The first plurality of string support members 70 and 72 is removed from the musical instrument 12 and a second plurality of string support members 70 and 72 are mounted on the musical instrument at the location adjacent to the connection 46 between the head and neck portions 18 and 16 of the musical instrument 12. At least one string 40 is supported with the second plurality of string support members 70 and 72 with the at least one string a second distance from the side surface of the neck portion of the musical instrument.

Having described the invention, the following is claimed:

1. A stringed musical instrument, said stringed musical instrument comprising a body portion, a neck portion connected with and extending outward from said body portion, a head portion connected with said neck portion, a plurality of tuning devices mounted on said head portion, a plurality of strings each of which extends from one of said tuning devices along said neck portion to said body portion of said instrument, a base member connected with said musical instrument adjacent to a connection between said head and neck portions, and a plurality of pairs of string support members connected with said base member, a first one of said pairs of string support members including first and second string support members which cooperate with a first one of said strings of said plurality of strings, said first string support member in said first one of said pairs of string support members including a first mounting section which is connected with said base member, a first string positioning section which extends from said first mounting section, said first string positioning section having a first arcuate outer side surface which engages said first one of said strings of said plurality of strings, and a first blocking section which extends from said first string positioning section in a direction away from said first mounting section to block movement of said first one of said strings from between said first and second string support members in a first direction, said second string support member in said first one of said pairs of string support members including a second mounting section which is connected with said base member, a second string positioning section which extends from said second mounting section, said second string positioning section having a second arcuate side surface which engages said first one of said strings of said plurality of strings, and a second blocking section which extends from said second string positioning section in a direction away from said second mounting section to block movement of said first one of said strings from between said first and second string support members in a second direction.

2. A stringed musical instrument as set forth in claim 1 wherein said first mounting section of said first string support member has a cylindrical configuration, said first blocking section has a cylindrical configuration and has a central axis which extends parallel to a central axis of said first mounting section, said second mounting section of said second string support member has a cylindrical configuration, said second blocking section has a cylindrical configuration and has a central axis which extends parallel to a central axis of said second mounting section.

3. A stringed musical instrument as set forth in claim 2 wherein said first arcuate outer side surface of said first string positioning section has a configuration corresponding to the configuration of at least a portion of a cone, said first arcuate outer side surface of said first string positioning section having a central axis which extends parallel to the central axis of said first mounting section, said second arcuate outer side surface of said second string positioning section having a configuration corresponding to the configuration of at least a portion of a cone said second arcuate outer side surface of said second string positioning section having a central axis which extends parallel to the central axis of said second mounting section.

4. A string musical instrument as set forth in claim 1 further including a groove formed in said musical instrument adjacent to a connection between said head portion and said neck portion, said groove having first and second side surface areas which are disposed in spaced apart planes and extend transversely to longitudinal central axes of said strings, said base having a resiliently deflectable mounting section which engages said first and second side surface areas of said groove, said mounting section of said base is resiliently deflected by force transmitted between said mounting section of said base and said side surface areas of said groove as said mounting section of said base is moved into said groove, said base being held against movement relative to said head and neck portions of said stringed musical instrument by engagement of said mounting section of said base with said side surface areas of said groove.

5. A stringed musical instrument as set forth in claim 4 wherein said mounting section of said base includes a longitudinal slot which extends transversely to longitudinal central axes of said strings to facilitate resilient deflection of said mounting section of said base as said mounting section of said base is moved into said groove.

6. A method comprising the steps of providing a musical instrument having a head portion and a neck portion, providing a first plurality of string support members, said string support members of said first plurality of string support members are of a first size, providing a second plurality of string support members, said string support members of said second plurality of string support members are of a second size, mounting the first plurality of string support members on the musical instrument at a location adjacent to a connection between the head and neck portions of the musical instrument, supporting at least one string with the first plurality of string support members with the at least one string a first distance from a side surface of the neck portion of the musical instrument, removing the first plurality of string support members from the musical instrument, mounting the second plurality of string support members on the musical instrument at the location adjacent to the connection between the head and neck portions of the musical instrument, and supporting at least one string with the second plurality of string support members with the at least one string a second distance from the side surface of the neck portion of the musical instrument.

7. A method as set forth in claim 6 wherein said step of mounting the first plurality of string support members on the musical instrument includes positioning at least a portion of a first base member to which the first plurality of string support members are connected in a groove formed the musical instrument at the location adjacent to the connection between the head and neck portions of the musical instrument, said step of removing the first plurality of string support members from the musical instrument includes removing the first base member from the groove with the first plurality of string support members connected with the first base member, said step of mounting the second plurality of string support members on the musical instrument includes positioning at least a portion of a second base member to which the second plurality of string support members are connected in the groove formed in the musical instrument at the location adjacent to the connection between the head and neck portions of the musical instrument.

8. A method as set forth in claim 6 wherein said step of mounting the first plurality of string support members on the musical instrument includes positioning at least a portion of a base member to which the first plurality of string support members are connected in a groove formed in the musical instrument at the location adjacent to the connection between the head and neck portions of the musical instrument, said step of removing the first plurality of string support members from the musical instrument includes the step of disconnecting the first plurality of string support members from the base member, said step of mounting the second plurality of string support members on the musical instrument includes connecting the second plurality of string support members with the base member.

9. A method as set forth in claim 8 wherein said step of connecting the second plurality of string support members with the base member is performed with the base member in the groove formed in the musical instrument.

10. A method as set forth in claim 8 wherein said step of connecting the second plurality of string support members with the base member is performed with the base member spaced from the groove in the musical instrument.

11. A method as set forth in claim 6 further including the steps of playing the musical instrument with the first plurality of string support members on the musical instrument and subsequently playing the musical instrument with the second plurality of string support members on the musical instrument.

* * * * *